US006332284B1

(12) United States Patent
Tafforeau

(10) Patent No.: US 6,332,284 B1
(45) Date of Patent: Dec. 25, 2001

(54) PANEL DISPLAY WITH A STRETCHABLE STRUCTURE

(76) Inventor: Jean-Luc Tafforeau, 15 rue Lamartine, Nanterre 92000 (FR)

( * ) Notice: Subject to any disclaimer, the term of this patent is extended or adjusted under 35 U.S.C. 154(b) by 0 days.

(21) Appl. No.: 09/357,396

(22) Filed: Jul. 20, 1999

(51) Int. Cl.[7] ..... G09F 17/00

(52) U.S. Cl. ..... 40/603; 40/604; 40/610; 160/135; 248/165

(58) Field of Search ..... 40/603, 604, 610; 160/135, 351; 248/165, 163.2

(56) References Cited

U.S. PATENT DOCUMENTS 1,646,305 * 10/1927 Meyers ..... 40/603
2,160,456 * 5/1939 Evans et al. ..... 40/603
5,839,705 * 11/1998 LaMotte ..... 40/603
5,983,545 * 11/1999 Marco ..... 40/603

FOREIGN PATENT DOCUMENTS

9301769 * 4/1993 (DE) .
768634 * 4/1997 (EP) .

* cited by examiner

*Primary Examiner*—B. Dayoan
*Assistant Examiner*—Andrea Chop
(74) *Attorney, Agent, or Firm*—Millen, White, Zelano & Branigan, P.C.

(57) ABSTRACT

A panel display having a stretchable structure made of articulated, tubular elements collapsible together with an internal elastic cord. The elements are articulated on a central assembling support for mounting. Some relatively rigid elements are fixed on the support while obliquely diverging away from it so as to form feet with a ground footprint shaped as a regular polygon. Other elements form relatively flexible bows each of which will respectively support at its free end a suspendible panel in its middle.

18 Claims, 4 Drawing Sheets

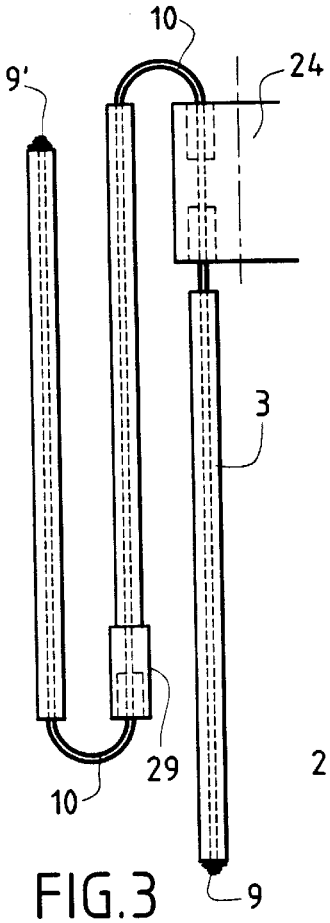
FIG.3
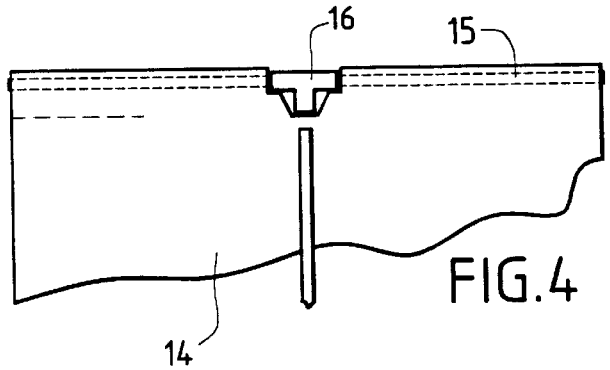
FIG.4
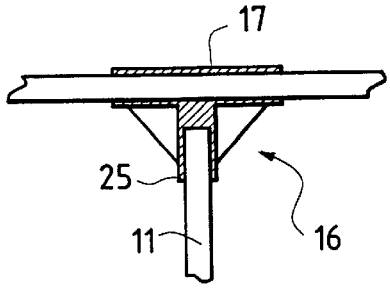
FIG.5
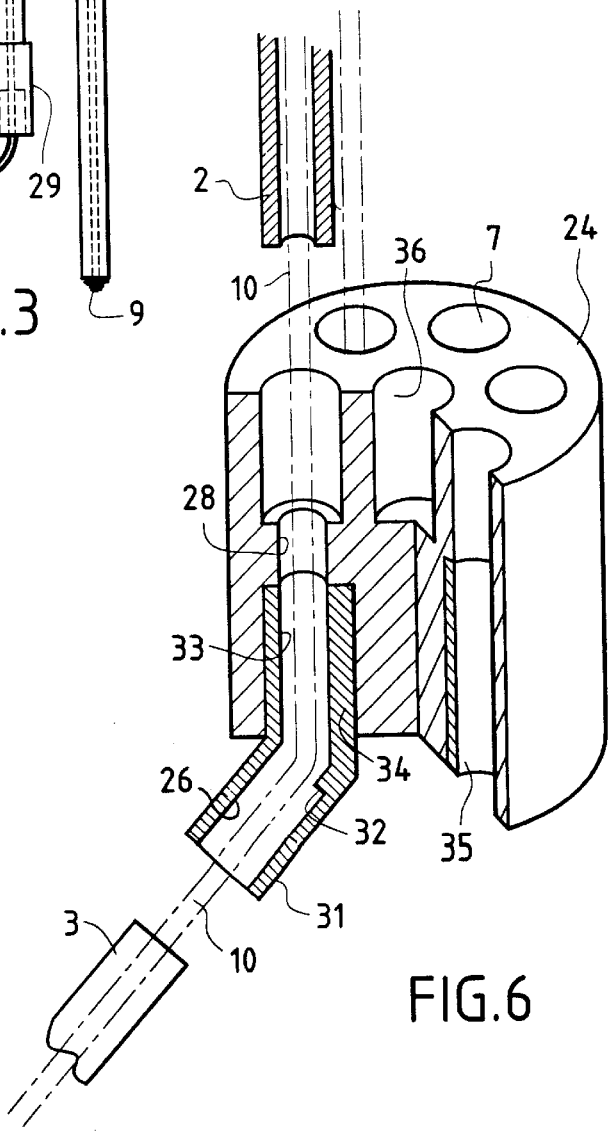
FIG.6
FIG.7
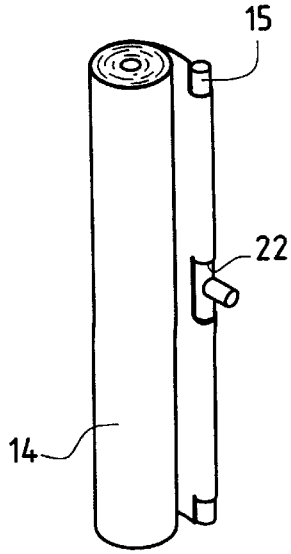

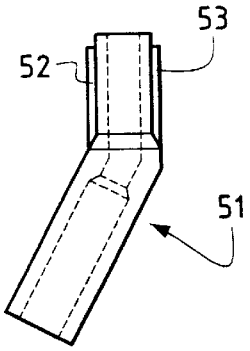
FIG.15
FIG.12
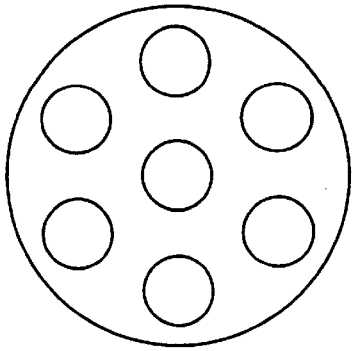
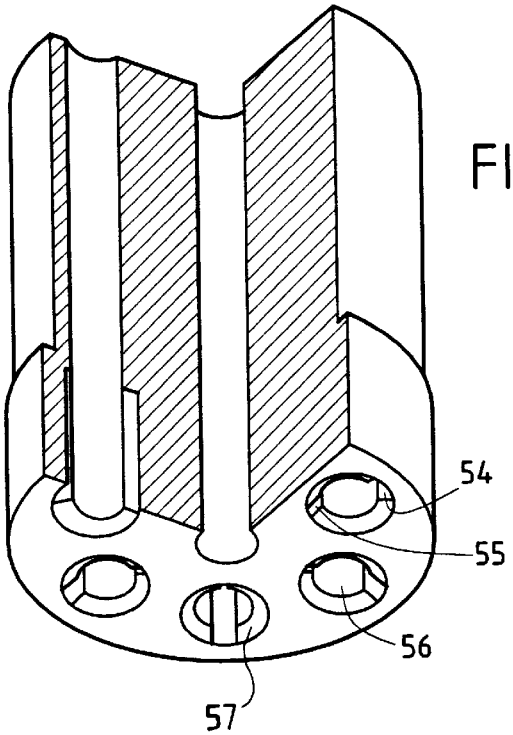
FIG.16
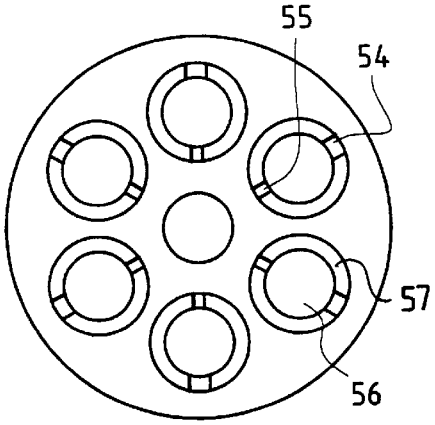
FIG.13
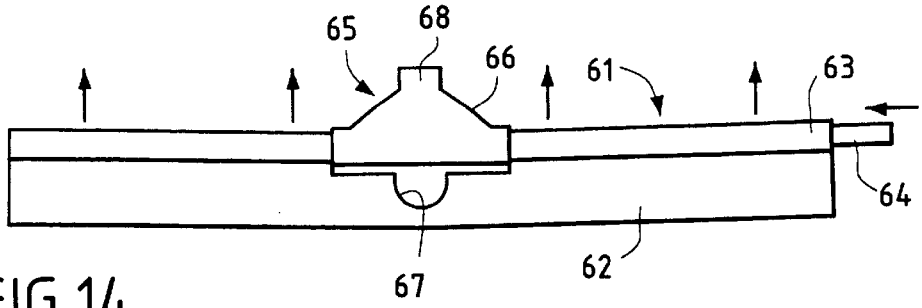
FIG.14

PANEL DISPLAY WITH A STRETCHABLE STRUCTURE

The present invention refers to a display having a structure which can at will be folded or stretched or, in other terms, a stretchable structure, designed for displaying information panels, of the type which in particular is used for buidling up quickly mountable and dismountable stands, which are both lightweight and easily transportable from one exhibition to another.

Displays are known which easily can be stored in lightweight, compact bags because they include a stretchable structure consisting of articulated rods which can be mounted and assembled to form a ground support and receive flexible display panels, which can also be wrapped around themselves.

In a prior art display model, the thus shaped stretchable structure includes four rods, which, once they have been rigidly inserted into one another, define a rectangular frame resting on the ground by its four sides. It furthermore includes other rods to be assembled to the latter in order to constitute a support on which a single information panel can hang while being held tensioned in its display position. In order for this frame shaped foot base to be hidden behind the panel, its weight must be displaced towards the center of the polygon formed by the rectangular ground seating frame, which results in the display becoming quite complicated to operate, and the panel orientation compulsorily having to be slanted towards the rear with respect to the vertical.

Although the foot base and the support consist of lightweight tubular elements to be mounted by being inserted into one another while still remaining articulated and collapsible together by means of an internal elastic cord which permanently links them, those displays further suffer of the inconvenience that their usability is very limited. Not only can they only receive at any particular time one single fixed panel, tensioned between their extreme edges, but also they lack stability and need both high precision for their design and great care when being manipulated for their mounting and dismounting.

For panels which are naturally designed for being successively displayed in many manifestations, it is highly desirable to have a display with a stretchable structure which doesn't suffer from the above mentioned inconveniences and only requires, when folded, a space small enough to be housed in a small size box or bag, to be carried with one hand.

The invention meets these various needs of the industrial practice as well as others which will better appear in the following description. For this purpose, it realizes the stretchable panel reception structure by means of rods which, in a manner known per se in other fields (such as camping tents), consist of tubular elements, being insertable into one another in a butt relation and linked by a common internal elastic cord located inside said elements which allows a collapse of the rods upon themselves while maintaining the elements assembled by means of the elastic cord. The invention also provides that the panels to be displayed on the display can easily be separated from said structure proper and be stored, wrapped around themselves in a manner known per se.

The primary object of the invention consequently is a panel display having a stretchable structure made of articulated, tubular elements, insertable into one another and collapsible together and on a central assembling support designed for their mounting, whereas on the one hand some such relatively rigid elements obliquely diverge away from it so as to form a foot base with a ground seating shaped as a regular polygon, and whereas on the other hand some such elements form as many relatively flexible bows each of which will respectively support a panel which hangs from its upper edge while elastically flexing by virtue of the tension applied thereto by the panel.

According to a secondary feature of the invention, each panel is made of a fabric which can be wrapped around itself and has at each of two opposite end edges thereof a transverse bar with a connection in its middle for its dismountable fixation by hooking at the upper free end of a bow, and preferably as well to the ground support end of one of the foot base elements, in such a way that the panel is tensioned between said edges.

The foot base elements which consequently are the feet of the stretchable structure advantageously are regularly angularly distributed while diverging with the same slant with respect to the vertical defined by the assembling piece axis. They preferably are grouped three by three according to a rotational symmetrical distribution of a ternary order, so that the foot base constitutes a tripod, with a ground seating shaped as an equilateral triangle.

The stability of a display of such a structure is easily insured during its mounting, which avoids any inopportune loss of balance, which would cause the display to fall. Since the weight and dimensions of the various panels being used generally are at least close to one another, or often identical, they advantageously participate in this stability.

The panels will in practice automatically locate themselves so as to form a trihedron perpendicular to the foot plane. If their width is appropriately chosen in correspondence with the foot base, they will vertically and contiguously arrange themselves, thus hiding the stretched structure within a closed volume shaped as a right trihedron. The latter however only is an exemplary case of a right prism since the triangular base does not limit the invention, and the same operation and the same expected advantages from the invention can be found if the number of feet and bows is increased. In all cases, the mounting will thus be facilitated since the balance already initially brought by the ground support will not be broken at any time, inasmuch as the panels are, if needed, hanged one by one at the upper part before being tensioned by being hooked with the foot base at the lower part.

When dismounting the display, the structure panels are first unhooked to be stored wrapped around themselves, thus notably around one of the transverse bars which stiffen their extreme edges. Each of the elements constituting the structure is then pulled and disengaged from its insertion state by extending the internal elastic cord. While being brought to the folded position against one another around the central support, they however remain linked with one another by the internal elastic cord. Upon remounting, the elastic cords will again play their role by exerting a return effect, which immediately engages the insertion type fixation assemblies into their correct position. This allows easily and quickly mounting and dismounting the display without any risk of error.

According to an embodiment of the invention, the central support is shaped so as to insure that the feet will slantingly diverge, with respect to the vertical, by an angle between 25 and 70 degrees, and preferably between 30 and 60 degrees. Within this range, it is advantageous to design a possibility for two complementary foot bases, each of which will be mounted in the same central assembling support, but with a different slant and within angularly displaced planes.

The stretchable structure can thus be presented under at least two interchangeable versions, depending upon the foot set being used. The invention in particular preferably arranges for the same central support to be able alternatively combined with either a small tripod or a large tripod that differ from one another by the size of the ground seating triangle, which leads to a display being modulable according to the ground space to be occupied by the trihedral volume limited by the panels.

Advantageously, the central support will be designed, with respect to its main piece, so that the feet of one foot base will automatically be positioned in bisector planes with respect to the feet of the other foot base during the mounting phase. This arrangement for instance allows a possibility of displaying panels of various dimensions by choosing one or the other of the tripods, with feet adapted to bear on the ground respectively either at the summits of an equilateral triangle or at the middles of its sides.

Depending upon the length and the orientation of the feet in both foot bases, those feet also can be made such that they all bear on the ground while being fixed on the same main central support piece, when both foot bases are used together. If the basic structure furthermore consists, for instance, of six bows for two tripod type foot bases, the display can be realized to allow simultaneously displaying six vertical panels being placed parallel to the sides of a regular hexagon. The stability of the display of the invention is further improved in such a case.

While keeping the same functions for the same features of the invention, these embodiments can also be extended to more than two tripods, as well as to foot bases shaped differently from tripods. In fact, the same features are applicable to ground seating polygons other than triangles and consequently, for instance, to panels shaped as right prisms on a square base, with feet arranged according to an octagonal rotational symmetry.

According to one embodiment of the invention, the bows are directly assembled with the central support in a main assembling piece which receives the feet, and each bow is mounted on this piece, during the structure mounting phase, by having its lower end inserted into a receiving bore arranged for this purpose in said piece, parallel to its main axis. Advantageously, the assembling piece in such a case includes in its upper part a series of regularly angularly distributed bores around its axis, adapted to panels of a single determined width. It thus constitutes a barrel, advantageously with a cylindrical geometry.

According to another embodiment of the invention, a vertical rod is provided to be fixed, at one of its ends, in the main assembling piece and thus form a central pole, which, at its other end, bears a secondary assembling piece receiving the bows. Like the feet in the foot base, the pole consists of a tubular element with an internal elastic cord, and the assemblies and fixations of the tubular elements or rods are realized on the secondary assembling piece in the manner described above for the main assembling piece.

To allow fixing such an intermediate pole between the foot base and the panel suspension bows, the main assembling piece includes an axial bore opening in its upper face and designed for receiving a rod end. Since the secondary assembling piece does not need receiving feet made up of slanting rods, it preferably is realized as a simple barrel, consisting of a cylindrical piece having a central bore (for the rod forming the central pole) and six other bores, equally angularly distributed on an annular crown for fixing the bows.

According to another feature of the invention, the main assembling piece, advantageously made of a polymer material by molding, is shaped as a barrel which includes longitudinal cells; individual connections are attached to this barrel for the feet which are bent according to an open angle and consequently have an upper branch forcibly or snappingly engaging into a lower cell part, and a lower branch for receiving a foot to be insertedly mounted therein. A longitudinal keying between the upper connection branch and the cell receiving it advantageously insures the oblique foot orientation in the proper plane.

It should be noted that it often is possible, and even advantageous, would it be just for economic reasons in manufacturing, to only use, in the practice of the invention, the same internal elastic cord for linking together a foot and a bow through one of the bores of the assembling piece. The diameter of such a bore is then equal to or larger than the diameter necessary for passing the cord. To insure the linking by means of the cord, it then only is needed to form knots at both of its ends, the foot end and the bow end. Those knots can be simply held on the wall of the tubular element.

Yet a further feature of the invention provides that the set, when dismounted, consisting of the feet and bows, collapsed on the assembling support, and the panels wrapped around their end bars is housed either inside an associated cylindrically shaped box or bag, advantageously having a handle or a shoulder strap, or inside a cover made of an analogous lightweight fabric.

The invention will be better understood and other features and advantages will appear upon reading the following description while referring to the appended drawings, in which:

BRIEF DESCRIPTION OF THE DRAWINGS

FIG. 3 represents a bow collapsed on the assembling piece;

FIG. 4 illustrates the upper part of a panel hookedly hanging from a bow of the stretchable structure;

FIG. 5 schematically represents an embodiment of the T connection equipping each transverse bar at the extreme edges of the panels;

FIG. 6 is a partly sectional, enlarged view of a main assembling piece, and of a fixing connection for a foot of the foot base;

FIG. 7 represents an information panel when stored wrapped around itself;

FIG. 12 is a schematic top view of the barrel of FIG. 10, illustrating the distribution of the cylindrical bores, which constitute its cells in their upper part;

FIG. 13 is a bottom view of the same main assembling part according to FIG. 10; and FIG. 14 illustrates in detail a particular embodiment of the transverse bars integrated with the panels in view of their rapid mounting onto the stretchable structure.

FIG. 15 represents a bent connection as a complement of the barrel of FIG. 10, to be fixedly mounted in the lower part of the cells thereof;

FIG. 16 is an enlarged view of a main, barrel shaped, assembling piece as an alternative to the piece of FIG. 6;

Figure 1:
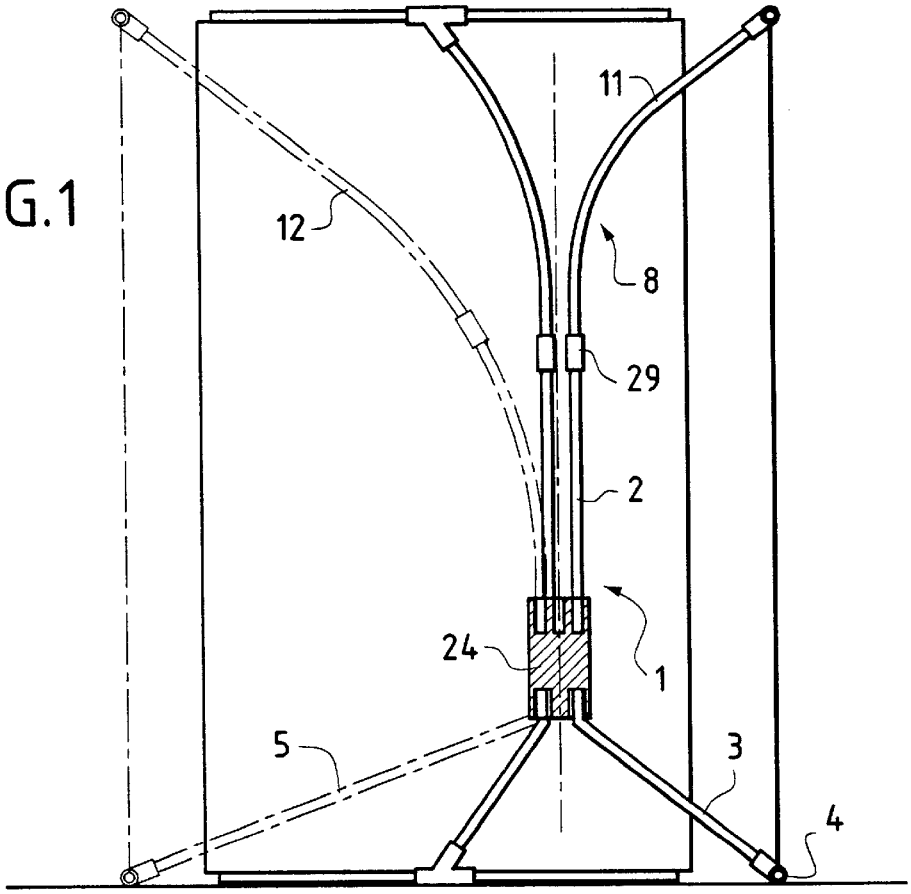
FIG. 1 is a general view of a display of the invention after mounting and assembling, with the panels being fixed, hanging from the stretched structure.

The stretchable display structure of the invention consists of elements which are fixed together according to a determined solitary relationship when the structure is stretched, but which also stay linked and flexibly collapsible together, when the display is stored within a small space. For this purpose, the structure consists of tubular elements of a type known per se, shaped as hollow rods receiving an elastic cord therein. This cord 10 insures a permanent link between the rods, which it crosses from end to end, while the elastic effect facilitates a quick and sure connection by butt insertion of successive rods. In the considered example, the internal elastic cord consists of a bundle of longitudinal wires of an elastic material, enveloped in a sheath made of a netting that does not impede the elasticity.

Flexible bows such as 8, 12, for instance, are formed by butt connecting two aligned elements 2 and 11 which always stay linked by a common elastic cord 10, whereas a structural element, when consisting of a single rod of appropriate dimension, can form a rigid foot 3, 5. The elastic cords are fixed at one free end of the element (bow or foot). At the other end, they can be fixed within an assembling piece thus realizing the mounting of the set, which is part of the central support 1.

It however often is preferred, as illustrated by FIG. 3, that the same cord 10 which crosses the piece 24 serves for a bow 8 and a foot 3 which are to be placed as extensions of one another, at the level of this piece. The fixation of cord 10 at the bow end on the one hand and to the foot end on the other hand, is simply insured here by forming a knot 9 or 9' at the cord end, to be held by being pressed against the tubular element wall when the cord is retracted by the elasticity effect.

The relative rigidity or flexibility of each foot and bow can be controlled in various ways, depending upon the dimensions, the element lengths and the panel weights, in particular by choosing the material, for instance carbon fiber based or glass fiber based materials, or the thickness of the tubular rod walls.

According to the invention, the stretchable display structure includes at least one main assembling piece 24 between a plurality of feet forming the foot rest and a plurality of bows to which panels hanging therefrom are connected.

The figures show that this piece 24 for this purpose includes, at its lower part, oblique connections 31 with cylindrical bores (FIG. 6) into which three feet 3 engage. The feet are oriented so as to thus constitute a rigid tripod. All three feet 3 have the same length, and the bores 26 are equally slanted, at 30 degrees here, from the vertical represented by the axis of the piece 24 (which is the axis of the central support 1). They are regularly distributed around the axis, according to a ternary rotational symmetry, and consequently 120 degrees angularly spaced apart, so that the free lower ends 4 of the feet 3 determine an equilateral support triangle on the ground.

In the described example, the piece 24 includes three further connections to mounting bores of a tripod. Those are distributed around the axis along the bisector planes between the previous connections, and oriented differently, at 60 degrees here with respect to the vertical axis. They are designed to receive three further 60 degree-slanted feet 5, which together constitute a second tripod, forming a second equilateral triangle, angularly displaced by 60 degrees from the previous one.

The feet 5 can be used as substitutes for the feet 3 of the first tripod or in combination with the latter, in case the lengths of the feet 3 and 5 are calculated so that their respective lower ends are aligned in the same horizontal plane at the ground level.

Figure 2:
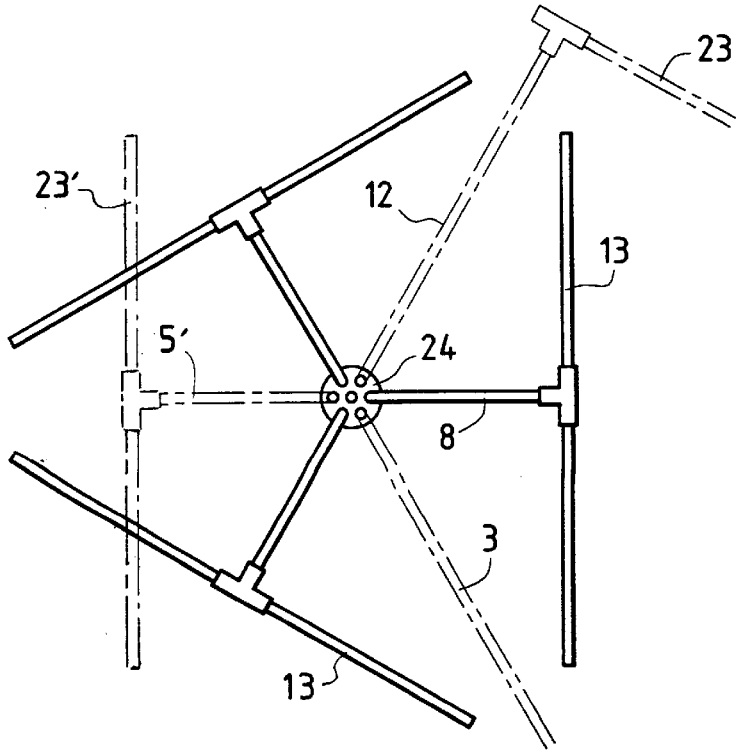
FIG. 2 is a top view of the display of FIG. 1, which illustrates possible mounting alternatives for the display, with two difference foot bases.

FIG. 2 in its right hand part illustrates the mounting of wider panels 23 in relation with a larger foot base, as compared with smaller width panels 13 correspondingly mounted with a small tripod. It also shows an alternative embodiment according to which the shorter feet 5' for the second foot base also can be used with panels 23' to close a regular hexahedron if all panels are of an appropriate width.

The main piece of the central support, as detailed in FIG. 6, is shaped as a barrel. It includes vertical cylindrical cells 7, in the upper part of each of which the rigid lower end of the rod 2 of one of the bows is housed. Those bows are relatively flexible so that they can be hand flexed by the user from their lower fixed end in order to hook a panel, and can then stay flexed under the weight and the tension of said panel.

Each of the bows consists of two aligned, mutually inserted rods, i.e. of a lower tubular element 2 and an upper tubular element 11 which are butt inserted into one another in the mounted state. In practice, the external diameter is the same for all rods, and a wider sleeve 29 (FIG. 3) is fixed upon and integral with the upper rod 11, for receiving the lower rod 2.

In the case where two similar, possibly interchangeable foot bases are provided, for instance of the triangular seat type, it is advantageous for reasons of modularity that the piece 24 includes six annularly distributed bores 7, which respectively can receive six bows 8, 12 in the mounting phase.

The display panels such as 13 are fixedly hanging at the end of an associated bow. They consist of a flexible rectangular fabric 14 including a rigid transverse bar 15 at both of its extreme, lower and upper, edges. Each bar 15 is equipped in its middle with a T connection, that can freely be oriented with respect to the bar 15 and the panel proper. Rather than a slit in its longitudinal part for mounting by elastically snapping onto the bar 15, this connection 16 consists in the example described of a tube 17 (FIG. 5) which is slid over the bar 15 until its blocked in the middle thereof, where an opening 22 has been cut out in the fabric 14. In the mounting phase, either the upper end of the rod 11 of a bow engages, as illustrated in the figure, into the perpendicular part 25 of the connection 16, or the lower end of a foot 3 engages in a symmetrical manner into this part.

Due to the bow flexibility, the panels can thus be vertically tensioned between the feet and bows, which will insure a good appearance as well as a good performance of the display. If the panel width is established so as to completely close a right trihedron, the arrangement can, as is proper, be improved by adding, to the display, removable connections with two or three branches for assembling together the ends of the upper bars 15 of contiguous panels and/or assembling the ends or their lower bars 15 with one of the feet 3.

As represented in FIG. 6 and already indicated, the main assembling piece 24 generally is shaped as a cylindrical barrel with vertical cells 7 for fixing the lower bow part in its upper face. Beyond an analogous crown 28 which serves as an abutment for the rod of the bow 2 while allowing the passing of the internal elastic cord 10, the same cells also constitute cylindrical cells for fixing the upper ends of the slanting feet by means of the connections 31.

It can be seen from this FIG. 6 that the oblique connection into which the foot 3 is inserted in practice is a bent connection, which is hollow from one end to the other to allow the cord 10 to pass all through. It includes a lower, effectively oblique branch into which the end of the foot 3 is inserted until it abuts onto an internal shoulder 32. The second branch 33, or upper branch, engages into the cell 7.

In order to reach a keyed fixation preventing any rotation inside the receiving cell, this upper branch, oriented parallel to the barrel axis, includes a longitudinal rib 34 which, by being housed in a cooperating slot 35 of the cell, forcedly places the connection in a determined orientation such that its first branch radially diverges from the symmetry axis of the piece 24. In the longitudinal direction, the correct position is insured, in the case of the present example, by an abutment at the bottom of the slot 35 or on the crown 28 (its lower face in FIG. 6).

The FIGS. 3 and 6 show how the cord links a foot with a bow, from one end to the other, because the crown 28 which partly closes the cell at half height, leaves in its center a throughway sufficient to allow the cord 10 to freely extend all through.

Once the display has been dismounted, the various constituting elements are collapsed sensibly parallel to one another while still being linked with the assembly piece 24 by the cord 10. The panels are detached from the feet and bows and are wrapped around one of their bars 15. The complete set is housed inside a small cylindrical box or bag, and can be hand carried.

At the exposition site, the collapsed structure and the panels are pulled out of the box, and the display can easily be mounted by aligning and engaging into one another the insertable tubular elements or rods, which constitute the feet and the bows. All that is then needed is stretching the panels and fixing each of them between a foot and a bow.

The mounting and dismounting operations consequently are very easy and quick. A rigid set is obtained, with well-positioned panels, avoiding any unbalance. This consequently constitutes a particularly stable set, free of any tilting risk.

Figure 9:
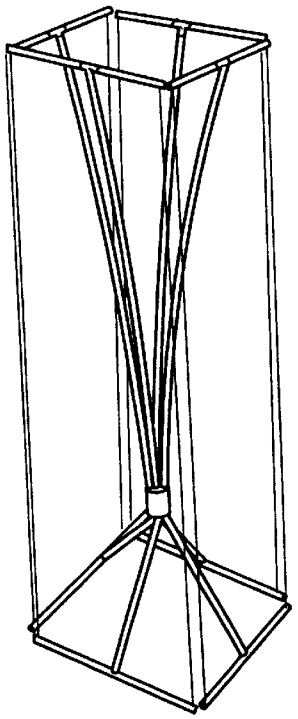
FIG. 9 shows a similar representation for a square based display.
Figure 8:
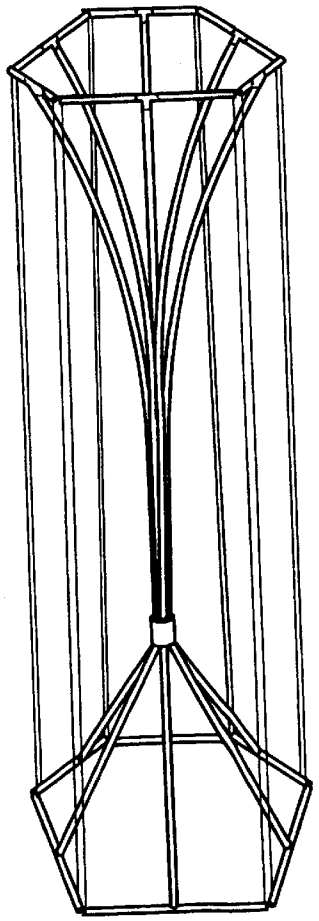
FIG. 8 illustrates the case of a hexagonal based display having six panels of identical width and height.

As already indicated, the invention is in no way limited to a triangular or hexagonal foot base pattern, like the ones exemplarily described above. The FIG. 8 illustrates the case of an hexagonally shaped seating base for six panels of an identical width which close an hexagonal prism, and the FIG. 9 shows a display of the invention in which the stretchable structure includes four bows and four feet corresponding to a square seating for receiving four panels of the same width.

Although the display described with reference to the FIGS. 1 to 6 rather is designed for use as a display with three panels defining a right trihedron, it also can be used for displaying a single panel. In such a case, it is recommended to assemble together the three bows by means of an intermediary link surrounding them. The storing bag will for this purpose include a band of a self-adhesive material of a type commercially available under the VELCRO brand name. A band of the same type is included in a much more general manner, inasmuch as the bows notably are longer than the feet and it can be desirable to stiffen them by uniting them at an intermediary height position in the display.

Figure 10:
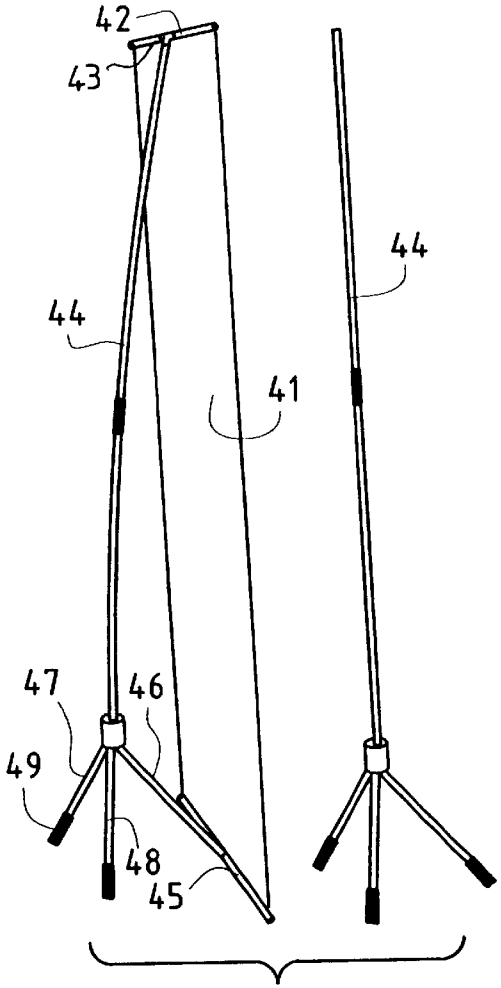
FIG. 10 is an alternative design for the display when it only includes a single panel.

The FIG. 10 illustrates an alternative design for improving the display stability when it only includes a single panel. As can be seen, a single bow 44 is used and the panel 41 is held tensioned in a slightly rearward slanting position with respect to the vertical. As previously it is fixed on top of a transverse bar 42, mounted by its middle connection 43 at the end of the bow 44. On the foot side, it rests on the ground by means of an analogous transverse bar 45, the connection of which is fixed with a rod 46 of the tripod foot base.

As compared with an embodiment with three vertical panels, the rod 46 forming the front foot in this case is longer than the two other rods 47 and 48 forming the rear feet. To put it more exactly, the length of the front foot rod is identical to the length chosen for the three-panel version, inasmuch as the materials and the individual panels are identical or at least similar, whereas both other feet are shortened.

Figure 11:
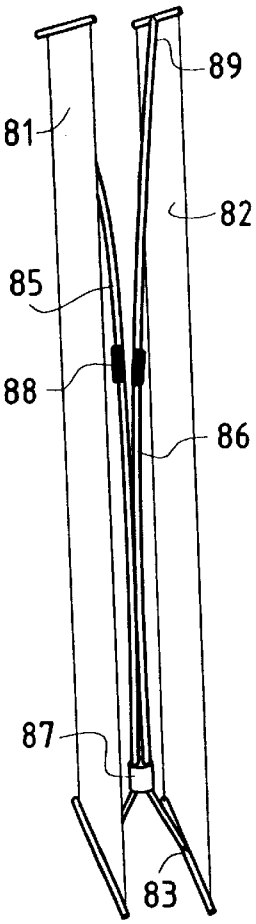
FIG. 11 is another alternative design for the display when it includes two symmetric panels.

According to another alternative embodiment, illustrated in FIG. 11, the various elements described above can be used for constituting the structure of a display to be used only with two symmetric panels 81 and 82, being vertically disposed back to back at a certain distance from one another. In this case as well, the lower transverse bar 83 of each panel, which rests on the ground, advantageously contributes to insure the stability of the set.

For the same purpose, it also is desirable that the foot rods are made substantially shorter than in the case of a triangular based mounting. They are arranged in two diametrically opposite cells of the central barrel 87, which constitutes the essential part of the main assembling piece. Both bows 85 and 86, respectively associated therewith for a same panel, are engaged by their lower ends in the same cell, but in the upper end, instead of the lower end, of the latter.

Inasmuch as the rod length of the collapsible bow is the same as above, each bow consisting of two insertable rods, aligned in an intermediary sleeve 88, is completed by an extension 89 and an analogous sleeve for extending the length of both rods so that insure that the corresponding panel is correctly tensioned, in a vertically oriented position, between the end of the foot with which it is fixed at the ground level and the end of the bow with which the middle connection of the upper transverse bar of the panel is engaged. The foot and the bow associated with the same panel will automatically be located in the same vertical plane. It namely is assumed here that, if the pole connection of each foot is rotationally fixed inside the lower end of a barrel cell by means of its associated connection, the lower end of the bow used for the same panel in contrast is rotationally free in the upper part of the cell.

Reverting now to FIG. 10, it can be seen that each of the feet 47 or 48 is terminated by a ferrule 49, which possibly is a simple sleeve adhered with the foot rod and exerting the function of protecting the knot of the internal elastic cord. If the feet comprise a tubular rod made of glass fiber, with an external diameter of 8 mm and an internal diameter of 5 mm, they can without any difficulty receive elastic cords with a 3 mm diameter, which cords are held by a knot on the terminal face of the tubular wall at the rod end.

While considering the same particular embodiment of the display of the invention, it is appropriate to clarify that the bows advantageously consist of tubes, made of a carbon fiber based material, divided into two parts for covering a total length of 1,60 mm. It however still is preferable to use two different materials for both parts of the bow, namely carbon fiber for the lower bow part, with an internal diameter of 6 mm and an external diameter of 8 mm, and a glass fiber for the second bow part, with tube diameters of 8 and 5 mm, like the foot base rods.

The FIG. 15 represents in a particular embodiment of the invention, a bent piece that constitutes a fixation connection of a foot with the central barrel. It namely can be seen that the connection 51, in contrast with FIG. 6, includes two external ribs 52 and 53 extending along diametrically opposite generators along the length of the longitudinal cylindrical branch designed to be inserted into the barrel cell. As a keying means to forbid any rotation of the piece inside the cells, both of these ribs are used and cooperate with two homologous slots in the barrel.

The perspective view of FIG. 16 and the bottom view of FIG. 13 show these slots, for instance the slots designated as 54 and 55. It can be seen that the slot 54 is located on a crown further away from the barrel axis than the diametrically opposite slot 55.

The same FIG. 13 also shows that the lower holes in the cells, such as 56, are chamfered in 57, and that the cells have a right cylindrical shape, beyond their lower part which receives the foot mounting connection 51 and until their orifice which opens into the upper face of the barrel, as illustrated in FIG. 12. In their lower parts, the lower ends of the rods forming the bow will directly engage therein. At the upper end, it can be useful to provide a cylindrical ferrule to be adhered inside the tube, in order to reduce the internal tube diameter and thus insure that the knot formed at the end of the elastic cord, which passes through the tube, will be held.

The FIG. 14 furthermore illustrates an alternative advantageous embodiment of the bars to be mounted at the end of each panel. Each of these pieces consists of a profile 61 made of an extruded polymeric material which is shaped as a flat blade 62, along a tubular bar 63 inside which a metallic rod 64 is housed. The panel will be fixed on this flat blade 62, at the limit of tube 63, by means of a double face adhesive ribbon.

The T connection 65 with its both stiffening wings 66 can be seen in the middle of the piece 61. In its middle, the flat blade 62 has a notch 67, limited to a part of its width. This allows the piece 65 to be better oriented on the panel by partly housing the vertical bar of the T 68. The ground support is thus even further improved.

For reasons of stability as well, but also to improve the tension of the panel fabric, the bar 61 is designed with a centered concave shape on both sides of the middle zone in which the connection 65 is located.

Quite obviously, the invention is in no way limited to the particular embodiments, which were described in detail as preferential alternatives. If such has not been mentioned yet, it should be indicated that it often is useful to produce each model in such a way that it only can be adapted to a limited number mounting modes, even within the frame of a modular manufacturing which employs the same basic pieces in the various final models. This is particularly true for various situations in which it can be desirable, for the intermediary mounting connections for the feet, to be adhesively fixed inside the corresponding cells.

What is claimed is:

1. A panel display comprising a stretchable structure made of articulated, tubular elements collapsible together with an internal elastic cord, wherein said elements are articulated on a central assembling support, said elements comprising:

first relatively rigid elements fixed to said central assembling support while obliquely diverging away from said support so as to form a stable foot base with transverse bars adapted to receive a suspendible panel, said bars being attached to said rigid elements at locations on the bars intermediate ends of the bars and forming a regular polygon, and second elements forming relatively flexible bows, each of which bows is individually adapted to respectively support at each free end a suspendible panel in the middle of an edge of such panel so that each bow will elastically flex by virtue of tension applied thereto individually by a single one of the panels.

2. A display according to claim 1 further including panels in combination therewith, wherein each of said panels is made of a fabric which can be wrapped around itself and has at each of two opposite end edges thereof a transverse bar with a connection in the middle of the panel for dismountable fixation at either an upper free end of a bow or a free end of a foot base, respectively.

3. A display cabinet according to claim 2, wherein said central support comprises a main assembling piece for mounting three slanting, regularly angularly distributed foot bases so as to constitute a tripod with a ground seating shaped as an equilateral triangle, and wherein three panels are associated therewith, each of which is made of a rectangular flexible fabric with a width adapted so as to close a right trihedron.

4. A display according to claim 3, wherein said central support is designed for mounting two foot bases, having the feet of which are angularly displaced from one another.

5. A panel display according to claim 1, wherein said central support is designed for mounting at least two rigid elements, each defining a foot base angularly displaced from an adjacent foot base.

6. A panel display according to claim 1 further including panels in combination therewith, wherein each of said panels is made of a fabric which can be wrapped around itself and has at two opposite end edges thereof a transverse bar with a connection in a middle portion thereof for dismountable fixation at either an upper free end of a bow or a free end of a foot base, respectively, whereas said transverse bars of said panels are curved so as to improve the tension of the panel when tensioned between such bow and foot base located in a same vertical plane.

7. A display according to claim 1, wherein said central support includes a main assembling piece shaped as a cylindrical barrel with longitudinal cells for mounting said bows therein, wherein each bow directly engages one of said cells, and oblique connections for mounting the first relatively rigid elements.

8. A display according to claim 1, wherein said central support includes a main assembling piece shaped as a cylindrical barrel with longitudinal cells for mounting said bows therein, wherein each bow is adapted to directly engage into an upper cell part in a freely rotatable manner, and foot mounting connections each of which has a longitudinal branch non rotatably engaging into a lower cell part and an oblique branch diverging away from the barrel axis.

9. A display according to claim 8, wherein the lower part of the barrel cells and the longitudinal branch of the foot mounting connections have cooperating, longitudinal, keying means to prevent the connections from rotating inside the cells wherein they engage.

10. A display according to claim 8, wherein a bow and a foot base which insert into the same barrel cells receive said internal elastic cord which freely crosses the barrel to link said bow and said foot base together from one end to the other.

11. A display according to claim 8, wherein said central support mounts two foot bases, having feet angularly displaced from one another.

12. A display according to claim 8, wherein said barrel and the foot mounting connections are rotationally symmetrically shaped so as to receive two foot bases having feet angularly displaced from one another so that bows corresponding to the feet are angularly displaced with respect to one another.

13. A display according to claim 12, further including panels in combination therewith wherein each of said panels is made of a fabric which can be wrapped around itself and has at two opposite end edges thereof a transverse bar with a connection in a middle thereof for dismountable fixation at either an upper free end of a bow or a free end of a foot base, respectively.

14. A display according to claim, wherein said central support includes a main assembling piece shaped as a cylindrical barrel with longitudinal cells for mounting said first relatively rigid elements therein by means of bent connections coupled by keying, and wherein said main assembling piece furthermore includes a central cell for receiving a vertical axial pole, to be fixed at one of its ends by being inserted into said main assembling piece and at its other end into a secondary assembling piece shaped as a cylindrical barrel with cells for mounting bows, whereas each bow is adapted to directly engage into a cell of said secondary assembling piece.

15. A display according to claim 1, wherein the bows are built by butt inserting at least two collapsible tubular elements, linked together by means of said internal elastic cord.

16. A display according to claim 1 further including panels in combination therewith, wherein said central support includes a main assembly piece shaped as a cylindrical barrel with longitudinal cells for mounting said bows into respective upper parts of the cells and for mounting said first relatively rigid elements by means of oblique connections engaging into respective lower parts of the cells, and each of said panels being made of a fabric which can be wrapped around itself and has at two opposite end edges thereof a transverse bar with a connection at the middle thereof for its dismountable fixation at either an upper free end of a bow or a free end of a foot base, respectively, the bows are built by butt inserting at least two collapsible tubular elements, linked together by means of said internal cord, whereby when in a disassembled state, said first and second elements can be folded on the assembling piece, and the panels wrapped around one of their transverse bars, and can be housed inside an associated, cylindrically shaped box.

17. A display cabinet according to claim 16, wherein said transverse bars are made of an extruded polymeric material with a profile adapted to receive a rigid metallic rod allowing mounting in at a middle part a T-shaped connection for mounting a foot base or one of the bows of a stretchable structure.

18. A panel display assembly including panels in combination therewith comprising:

a first and a second series of tubular lengthwise elements each having an elastically stretchable cord extending therethrough for a collapsible connection by butt engagement with another of said elements in same series, wherein the elements in said first series are relatively rigid elements, and said elements in said second series are relatively flexible, and further comprising a central assembling member having lower bores for a collapsible connection by butt engagement with at least three legs each made of at least one rigid element in said first series whereby each said leg extends in a direction obliquely diverging away with respect to a vertical axis of said central member down to respective corners of a regular supporting polygon for said assembly, and upper bores for a collapsible connection by butt engagement for bows of said flexible elements in said second series each up to an upper end for hanging thereto a respective one of at least three panels to be displayed, said panels then extending upright due to each said bow flexibly bending under the weight of the panel carried thereby.

* * * * *

UNITED STATES PATENT AND TRADEMARK OFFICE

CERTIFICATE OF CORRECTION

PATENT NO. : 6,332,284 B1
DATED : December 25, 2001
INVENTOR(S) : Jean-Luc Tafforeau It is certified that error appears in the above-identified patent and that said Letters Patent is hereby corrected as shown below:

Title page,
Item [54], Title, change "PANEL DISPLAY WITH A STRETCHABLE STRUCTURE" to -- DISPLAY CABINET WITH DEPLOYABLE PANELS --.

Column 10,
Line 20, delete "the";

Column 11,
Line 17, after "with" insert -- longitudinal --;
Line 17, after "mounting" insert -- the --.

Signed and Sealed this

Fifth Day of April, 2005

JON W. DUDAS
*Director of the United States Patent and Trademark Office*